US005279267A

United States Patent [19]

Takahashi et al.

[11] Patent Number: 5,279,267

[45] Date of Patent: Jan. 18, 1994

[54] AIR INTAKE PASSAGE ARRANGEMENT FOR A TWO-CYCLE ENGINE

[75] Inventors: Masanori Takahashi; Seiji Inoue, both of Shizuoka, Japan

[73] Assignee: Sanshin Kogyo Kabushiki Kaisha, Japan

[21] Appl. No.: 827,998

[22] Filed: Jan. 30, 1992

[30] Foreign Application Priority Data

Feb. 1, 1991 [JP] Japan ..... 3-031420

[51] Int. Cl.[5] ..... F02M 35/10

[52] U.S. Cl. ..... 123/73 B; 123/73 PP

[58] Field of Search ..... 123/65 BA, 73 A, 73 B, 73 C, 735, 73 PP

[56] References Cited

U.S. PATENT DOCUMENTS

| | | | |
|---|---|---|---|
| 2,041,708 | 5/1936 | Harper | 123/735 |
| 3,498,053 | 3/1970 | Johnston | 123/65 BA |
| 4,429,668 | 2/1984 | Nakagawa et al. | 123/73 A |
| 4,920,933 | 5/1990 | Iwai et al. | 123/73 A |
| 4,947,807 | 8/1990 | Flaig et al. | 123/73 A |
| 4,993,369 | 2/1991 | Breckenfeld et al. | 123/52 MV |
| 5,020,483 | 6/1991 | Watanabe | 123/73 A |
| 5,143,028 | 9/1992 | Takahashi | 123/65 BA |

FOREIGN PATENT DOCUMENTS

| | | | |
|---|---|---|---|
| 2142085 | 1/1985 | United Kingdom | 123/73 A |

*Primary Examiner*—David A. Okonsky
*Attorney, Agent, or Firm*—Bacon & Thomas

[57] ABSTRACT

An improved air intake passage arrangement for use on an internal combustion engine is disclosed wherein intake passages are integrated with the crankcase such that an outer wall of the crankcase defines an inner wall of the intake passages. This construction minimizes the size of the engine and promotes heating of the air flowing within the intake passages. In addition, depending upon the location of the fuel supply lines, the air intake structure of the present invention can enhance the vaporization of the fuel sprayed therein.

13 Claims, 3 Drawing Sheets

AIR INTAKE PASSAGE ARRANGEMENT FOR A TWO-CYCLE ENGINE

BACKGROUND OF THE INVENTION

1. Field of the Invention

The present invention generally pertains to a V-type two-cycle engine and, more particularly, to an integrated crankcase and air intake passage arrangement for use in a two-cycle engine.

2. Description of the Prior Art

V-type two-cycle engines, such as that represented by published Japanese patent application Hei 2-248628, are widely known in the art. This type of engine configuration includes two cylinder rows which are positioned approximately symmetrically on either side of a crankshaft to define the V-shape. In this type of two-cycle engine, separate air intake passages for each of the two cylinder rows are provided. In addition, a crankcase is attached to each cylinder row forming a crank chamber therebetween.

V-type two-cycle engines having pre-pressurized crank chambers are also known in the art as represented by U.S. Pat. No. 4,993,369. In such prior art arrangements, dual air intake passages are provided, one for each cylinder row. The air intake passages extend substantially parallel to each other and are located on either side of the engine crankshaft. Due to this positioning of the air intake passages and their separate connections to the engine block, the bulk of the engine is undesirably increased. The spatial volume within which the engine is to be mounted must also be larger in order to accommodate these air intake passages.

Therefore, there exists a need in the art for a V-type two-cycle engine including an air intake system which is compact so as to minimize the bulk of the engine and the required spatial volume within which the engine is to be mounted.

SUMMARY OF THE INVENTION

The present invention has as its object the improvement of providing a V-type two-cycle engine with a compact air intake system. This objective is realized by the present invention by providing a two-cycle engine having a cylinder block with two rows of cylinders in a V-configuration with air intake passages for each row of cylinders located approximately symmetrically on either side of the engine crankshaft. More particularly, the crankshaft is located within a crankcase having an outer wall which also defines the inner wall of the air intake passages.

These and other objects of the present invention will become more readily apparent from the following detailed description of a preferred embodiment thereof, when taken in conjunction with the drawings wherein like reference characters refer to corresponding parts in the several views.

DETAILED DESCRIPTION OF THE PREFERRED EMBODIMENTS

Figure 1:
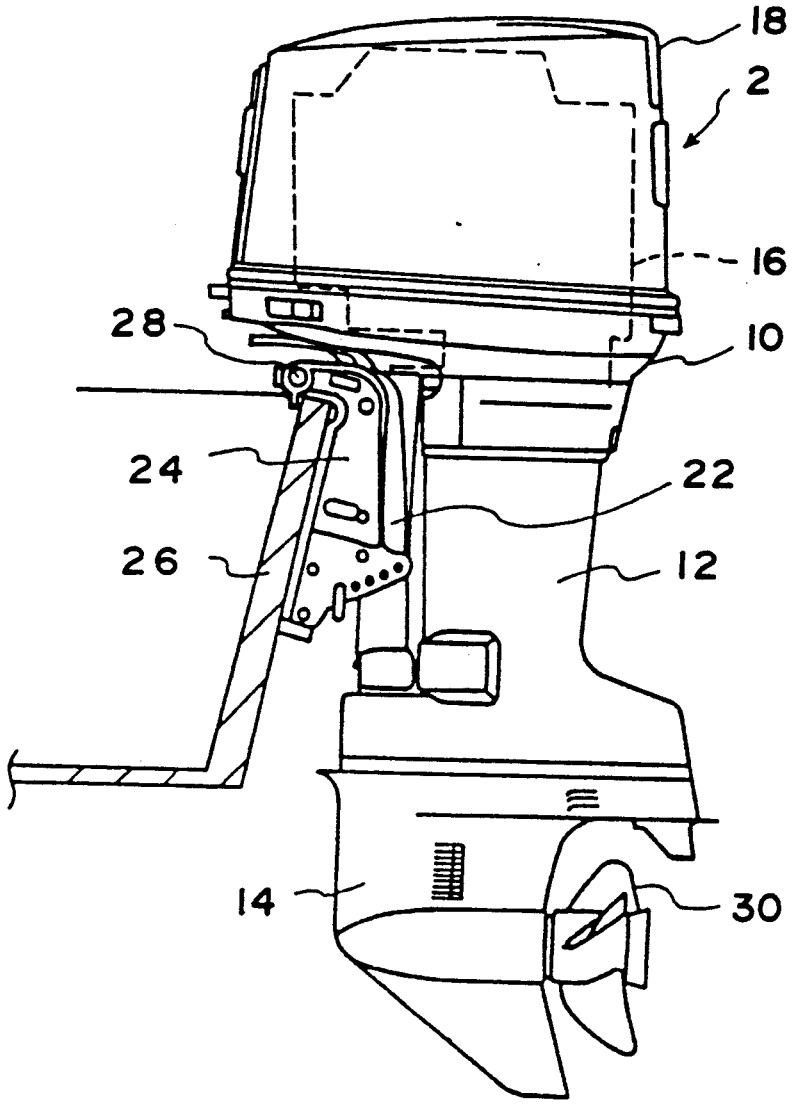
FIG. 1 depicts a side elevation view of a boat mounted marine outboard motor incorporating the engine arrangement of the present invention.

With initial reference to FIG. 1, a marine outboard engine unit incorporating the present invention is generally indicated at 2. Marine outboard engine unit 2 includes a bottom cowling 10, an upper casing 12 and a lower casing 14. Secured to bottom cowling 10 is a V-type two-cycle engine 16. In the preferred embodiment, engine 16 includes two cylinder rows each having three cylinders. Secured to bottom cowling 10 and covering engine 16 is an upper cowling 18. Outboard engine unit 2 is also equipped with a swivel bracket 22 which is pivotable relative to a clamp bracket 24 adapted to be secured to a transom 26 of a boat. Swivel bracket 22 defines a substantially upright axis about which outboard engine unit 2 may be rotated for steering purposes. In addition, swivel bracket 22 is pivotally attached to clamp bracket 24 through tilt shaft 28 which extends in a substantially horizontal direction, transverse with respect to the steering axis of outboard engine unit 2. As is known in the art, tilt shaft 28 permits outboard engine unit 2 to be pivoted thereabout in order to raise or lower outboard engine unit 2 relative to transom 26. As is also known in the art, outboard engine unit 2 includes a propeller 30 which is drivingly connected to an output shaft of engine 16.

Figure 2:
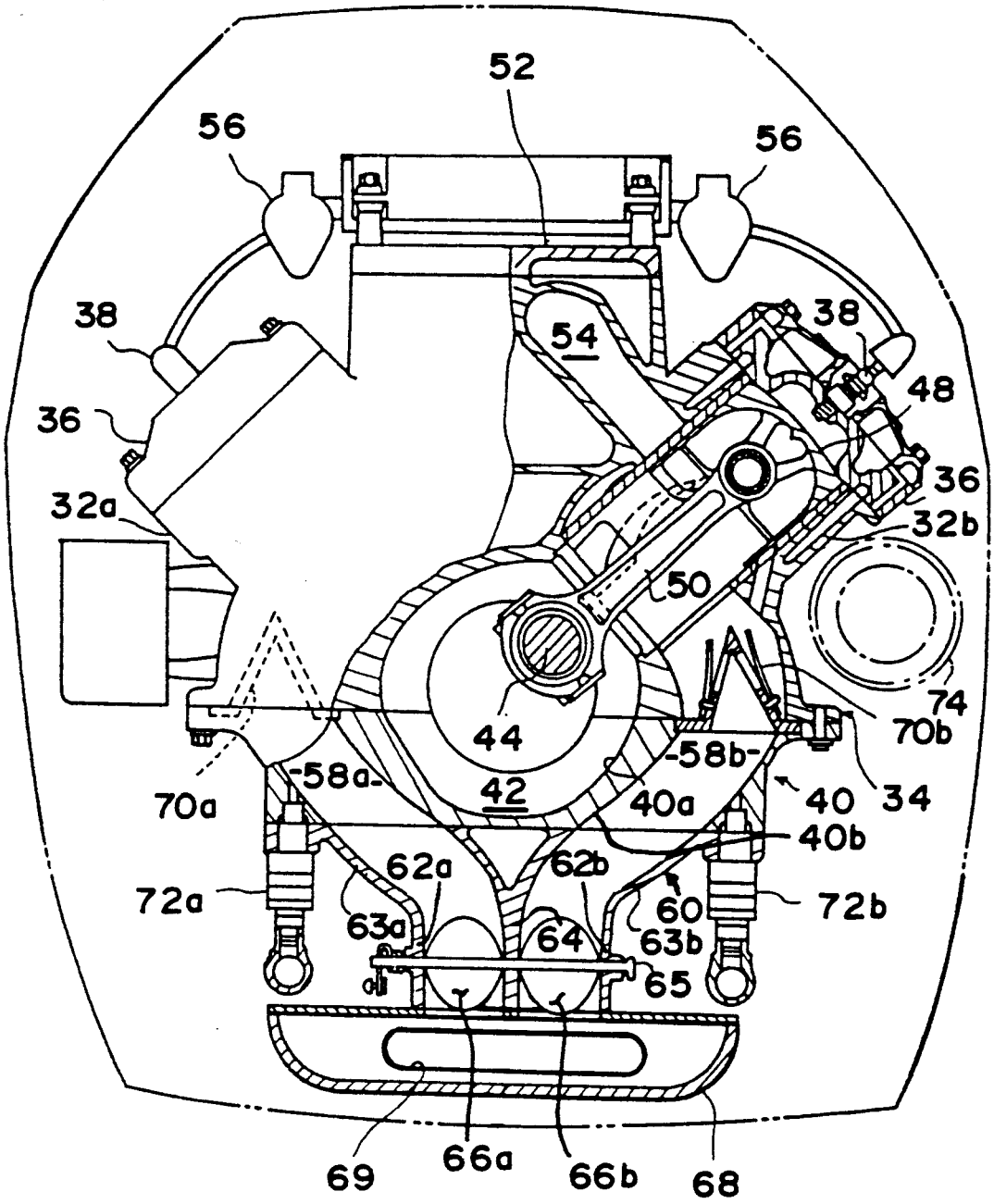
FIG. 2 is a partial cross-sectional top view of the engine shown in FIG. 1 depicting a first embodiment of the air intake system of the invention.

With reference to FIG. 2, a detailed description of engine 16 along with a first embodiment of the air intake passage arrangement of the present invention will be described. As previously discussed, engine 16 includes two rows of cylinders respectively indicated at 32*a* and 32*b*. Cylinders 32*a* and 32*b* share a common cylinder block 34, which together define a V-configuration. Each of the cylinder rows 32*a*, 32*b* are generally symmetrical and include a cylinder head 36 having apertures (not labeled) for spark plugs 38.

Engine 16 further includes a crankcase 40 which is attached to cylinder block 34 such that a crank chamber 42 is formed therebetween. Located within crank chamber 42 is a vertically disposed crankshaft 44. Crankshaft 44 is connected to a piston 48 located within each cylinder of cylinder rows 32*a* and 32*b* by means of respective wrist pins (not numbered) and connecting rods 50.

Between cylinder rows 32*a* and 32*b* of engine 16 is an exhaust cooling plate 52. An exhaust passage 54 is formed as part of engine 16 between exhaust cooling plate 52 and each cylinder row of cylinder block 34 (only one exhaust passage 54 being shown in FIG. 2). Exhaust gases entering exhaust passage 54 are conducted through an exhaust expansion chamber (not shown) to lower casing 14 where they are expelled. In the preferred embodiment, exhaust cooling plate 52 is cooled by engine coolant and has ignition coils 56 for spark plugs 38 mounted thereon.

In general, all of the structure shown and described with reference to FIGS. 1 and 2 up to this point are known in the art. Particular reference will now be made to portions of FIG. 2 in describing the unique air intake system of the present invention. Crank chamber 42 is defined by inside wall 40*a* of crankcase 40. Crankcase 40 also includes intermediate wall portion 40*b* which also defines an inner surface of air intake passages 58*a* and 58*b* which comprise ducts through crankcase 40. Air intake passages 58*a* and 58*b* include and are defined by an outer throttle body member 60. Throttle body 60 is comprised of first wall portions 62*a* and 62*b*, which are shown in cross-section to extend substantially parallel to each other in a spaced relationship in a plane which intersects the axis defined by crankshaft 44, and second or outer wall portions 63*a* and 63*b* which generally follows the contour of intermediate wall portion 40*b* of crankcase 40 and merge with the outer geometry of crankcase 40. Air intake passages 58*a* and 58*b* are separated by a dividing wall 64 which extends between first wall portion 62*a* and 62*b* and abuts a mating surface of crankcase 40. At this point, it should be recognized that dividing wall 64 may constitute part of throttle body 60 as described above or be formed integral with outer wall portion 40 of crankcase 40 while still functioning to divide air intake passages 58*a*, 58*b*.

Attached to a common shaft 65 which extends through first wall portions 62*a* and 62*b* along with dividing wall 64, is a pair of throttle valves 66*a* and 66*b* for regulating the air flow through air passages 58*a* and 58*b* respectively. Fixedly secured to throttle body 60 adjacent throttle valves 66*a* and 66*b* is an air intake housing 68 having an air intake opening 69. From the above description, it can readily be seen that air for combustion purposes can enter engine 16 through air intake opening 69 in air intake housing 68, and then flow into air intake passages 58*a* and 58*b* as regulated by throttle valves 66*a* and 66*b*. As shown in FIG. 2 and described above, air intake passages 58*a* and 58*b* are generally symmetrical on either side of crankcase 40 and throttle body 60. Air flowing through air intake passages 58*a* and 58*b* flows into cylinder block 34 on an intake side of cylinder rows 32*a* and 32*b* respectively through reed valves 70.

Also shown in FIG. 2 are fuel injector valves 72*a* and 72*b* located on respective sides of throttle body 60 which function to spray fuel toward reed valves 70*a* and 70*b*. In addition, a starter motor is depicted at 74. The specifics of the starter motor 74 are not shown in the drawings but, as commonly known, starter motor 74 includes a pinion which projects outward when engine 16 is to be started which engages a ring gear on a fly wheel magnet attached to the upper end of crankshaft 44.

With this arrangement, air intake passages 58*a*, 58*b* are integrated with crankcase 40 so that the air intake system can be located in close proximity to the crank chamber 42 and the volumetric size of the engine can be reduced. In addition, since at least a portion of air intake passages 58*a*, 58*b* is constructed as part of crankcase 40, the heat of crankcase 40 will function to heat the air flowing through intake passages 58*a*, 58*b* to promote the vaporization of the fuel ejected from valves 72*a* and 72*b*. The positioning of the fuel injection valve 72*a*, 72*b* are 72*b* are such that they are on curved portions of their respective air intake passages 50*a*, 50*b* so that there is a three-dimensional flow of fuel spray which also promotes vaporization of the fuel relative to a two-dimensional air intake flow system.

Figure 3:
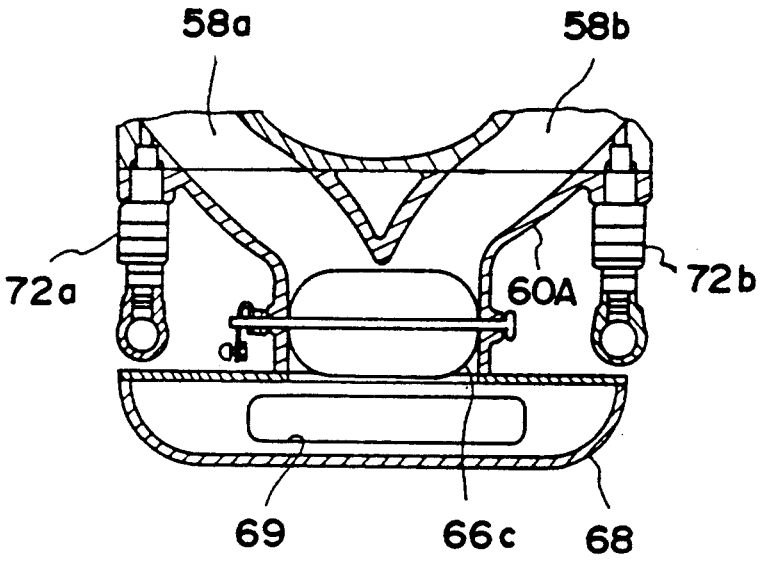
FIG. 3 is a partial cross-sectional top view of a second embodiment of the air intake system according to the present invention.

FIG. 3 shows another embodiment of the air intake system according to the present invention wherein a common opening for intake passages 58*a* and 58*b* is formed in a throttle body 60*a*. Within this common opening is located a single, roughly oval-shaped, throttle valve 66*c*. This common opening can readily be formed by minimizing the extension of the dividing wall which is indicated at 64*b* in FIG. 3. The remainder of the engine structure used in conjunction with the flow passage arrangement shown in FIG. 3 is the same as that described with reference to FIGS. 1 and 2 above and will therefore not be repeated here.

Although in both of the embodiments described above the fuel supply was provided by fuel injected valves 72*a*, 72*b*, it should be realized that a carburetor system could also be used. In that case, the heating of the air intake passages 58*a*, 58*b* through crankcase 40 would also promote fuel vaporization. It would further be possible to relocate air intake housing 68 above or below first wall portion 62*a* and 62*b* to further minimize the spatial mounting requirements of engine 16 without departing from the spirit of the invention. In general, various changes and/or modifications can be made to the embodiments described above without departing from the spirit and scope of the present invention encompassed in the following claims.

We claim:

1. A reciprocating piston internal combustion engine comprising:

a crankcase having inner and intermediate wall portions;

a V-type cylinder body including two rows of combustion cylinders in communication with said crankcase, each of said combustion cylinders having an associated combustion air intake port;

at least one intake opening positioned approximate a center line of the V-type cylinder body;

first and second flow passages for supplying combustion air to a respective one of said two rows of combustion cylinders, each of said first and second flow passages including a curved portion and being defined, at least in part, by said intermediate wall portion of said crankcase;

check valve means located within each of said first and second flow passages, each of said check valve means being located closer to its associated intake port than to said intake opening; and fuel supply means opening into each of said first and second flow passages at said curved portion thereof.

2. An internal combustion engine as claimed in claim 1, including a throttle body, said flow passages extending between said intermediate wall portion of said crankcase and said throttle body.

3. An internal combustion engine as claimed in claim 1, wherein at least a portion of each of said first and second flow passages comprises a duct through said crankcase, said intermediate wall comprising a wall of each of said ducts.

4. An internal combustion engine as claimed in claim 2, wherein said first and second flow passages include separate air inlet areas.

5. An internal combustion engine as claimed in claim 4, further including first and second throttle valves located within said separate air inlets areas respectively.

6. An internal combustion engine as claimed in claim 2, wherein said first and second flow passages include a common air inlet area.

7. An internal combustion engine as claimed in claim 6, further including a throttle valve located within said common air inlet area.

8. An internal combustion engine as claimed in claim 2, wherein each of said first and second flow passages comprises a continuous duct extending through said throttle body and through said crankcase, said intermediate wall comprising a wall of said ducts.

9. An internal combustion engine as claimed in claim 2, wherein said throttle body is secured directly against said crankcase.

10. An internal combustion engine as claimed in claim 9, wherein a section of said crankcase is connected, at various points, to said cylinder body and each of said check valve means is positioned at these connection points.

11. An internal combustion engine as claimed in claim 9, wherein each of said first and second flow passages comprises a continuous duct extending through said throttle body and through said crankcase, said intermediate wall comprising a wall of said ducts.

12. An internal combustion engine as claimed in claim 11, including means for supplying fuel to said ducts.

13. An internal combustion engine as claimed in claim 12, wherein said fuel supply means is arranged to supply fuel to a portion of the ducts extending through said crankcase.

* * * * *